United States Patent [19]

Rhodes et al.

[11] 4,338,861

[45] Jul. 13, 1982

[54] HIGH "G" FIRING MECHANISM

[75] Inventors: Richard R. Rhodes, Stroudsburg; Robert L. Kenney, Jr., Philadelphia, both of Pa.

[73] Assignee: The United States of America as represented by the Secretary of the Army, Washington, D.C.

[21] Appl. No.: 184,716

[22] Filed: Sep. 8, 1980

[51] Int. Cl.[3] ..... F42C 15/20; F42C 1/02

[52] U.S. Cl. ..... 102/261; 89/1 B; 102/274

[58] Field of Search ..... 102/261, 260, 274; 89/1 B

[56] References Cited

U.S. PATENT DOCUMENTS

| | | | |
|---|---|---|---|
| 2,512,179 | 6/1950 | Shinkle | 102/260 X |
| 2,996,989 | 8/1961 | Grandy | 102/261 |
| 3,657,958 | 4/1972 | Wells | 102/261 X |
| 3,901,155 | 8/1975 | Huber | 89/1 B X |
| 4,004,488 | 1/1977 | Williams | 102/261 X |

*Primary Examiner*—David H. Brown

*Attorney, Agent, or Firm*—Nathan Edelberg; Robert P. Gibson; Max Yarmovsky

[57] ABSTRACT

The invention relates to a firing mechanism for high acceleration applications having a body member having a first chamber, a second chamber and a web member separating the first chamber from the second chamber. A first spring is positioned within the first chamber and a second spring is positioned with the second chamber. A firing pin is positioned substantially in the first chamber and has a spring retaining section at its forward end and a release cam mechanism at its rearward end. An arming pin is positioned substantially in the second chamber and has a spring retaining section at its rearward end and a release cam mechanism at its forward end. The release cam mechanism of said arming pin is dimensioned to interlock with said release cam mechanism of the firing pin with the two release cam mechanism and is positioned within the web member and is restrained against release by the web member. The firing pin and the arming pin are movable together in the rearward direction to a position in which the interlocked release cam mechanisms are outside of the web member and free to separate.

8 Claims, 6 Drawing Figures

HIGH "G" FIRING MECHANISM

The invention described herein may be manufactured, used and licensed by or for the Government for governmental purposes without the payment to us of any royalties thereon.

BACKGROUND OF THE INVENTION

1. Field of the Invention

This invention relates to a firing mechanism and in particular to a firing mechanism having increased firing pin energy for high acceleration applications.

2. Brief Description of the Prior Art

The results of tests conducted by the Air Force on mid-air retrieval parachute systems revealed a need for high "g" reefing line cutters. The ability to withstand acceleration as high as 2,000 "g"s is required in such systems. The high "g" requirements presented a difficult design problem and it appeared that the 2,000 "g" upper limit might well be beyond the state-of-the-art. The design problem hinges on the fact that the currently used conventional firing mechanism, nearly optimized within the constraints of a maximum arming line pull force limitation of 35 pounds, can provide reliable performance only up to a 700 "g" maximum acceleration. In order to operate under 2,000 "g"s, a minimum firing pin force of 52 pounds would be required. This would increase the necessary line pull to 52 pounds, well over the maximum limit.

SUMMARY OF THE INVENTION

It has now been found that increased firing pin energy to the required level, with no accompanying increase in arming line pull can be achieved through the use of a precompressed assist spring system.

The desired result is achieved by precompressing a pair of opposing springs and holding the springs under compression between two releasably secured members.

A force is applied in a first direction to one member, increasing the compression on one of the springs and decreasing the compression on the other spring. The force on the other member is thus being assisted as a result of the precompression of the springs. In response to a predetermined force level being reached, the two members are separated as a result of which the one member is driven in a direction opposite that of the direction of application of the force and at a force level equal to the applied force plus the precompression force.

The structure of the firing mechanism includes a body member having a first chamber, a second chamber and a web means separating said first chamber from said second chamber. A first spring means is positioned within the first chamber and a second spring means is positioned with the second chamber. A firing pin means which is positioned substantially in the first chamber and has a spring retaining means at its forward end and a release cam means at its rearward end. An arming pin means is positioned substantially in the second chamber and has a spring retaining means at its rearward end and a release means at its forward end. The release cam means of said arming pin is dimensioned to interlock with said release cam means of said firing pin with the two release cam means positioned within said web means and restrained against release by said web means. The firing pin means and said arming pin are movable together in the rearward direction to a position in which the interlocked release cam means are outside of said web and free to separate.

BRIEF DESCRIPTION OF THE DRAWINGS

The objects and advantages of the invention will become apparent from the following detailed description of the invention, particularly when read in conjunction with the drawings, wherein.

DETAILED DESCRIPTION OF THE INVENTION

Figure 1:
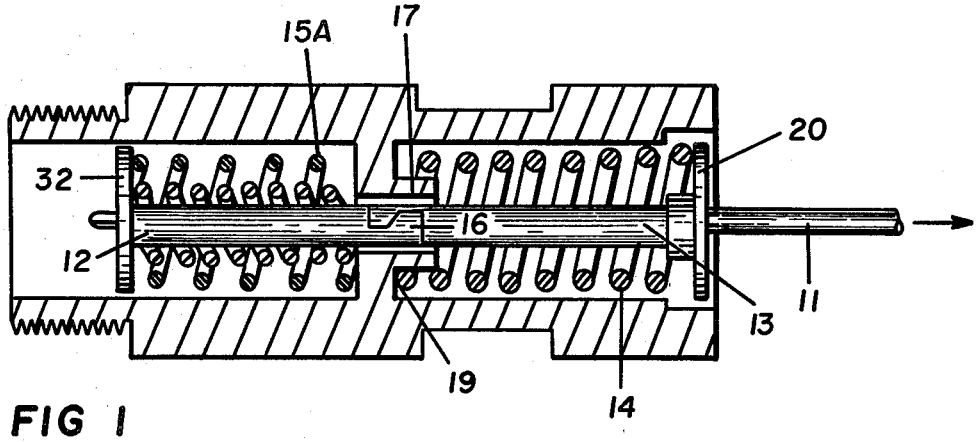
FIG. 1 is a cross-sectional view of a firing mechanism in accordance with the present invention.

FIG. 1 illustrates the high "G" firing mechanism in a prestressed state. The pair of coacting coaxial firing springs 15*a* and 15*b* are compression coils. The assist spring 14 is precompressed and is positioned around the arming pin 13 with a first end positioned within a spring receiving groove region 19 of a web 17. The second end presses against the back plate 20 of the arming pin 13 and serves to drive the arming pin 13 in the direction of the arrow 22, thereby aiding the arming line in the cocking of the firing pin 12. A balance of forces is provided by the combined effects of the precompressed assist spring 14 and the compression force on the pair of firing springs 15*a* and 15*b*.

When a pulling force is exerted on the lanyard 11 in the direction indicated by the arrow 22, the firing pin 12 and arming pin 13 begin to travel within the web 17, moving the release cam region 16 of the firing pin 12 and the arming pin 13 to a region outside of the confines of the web 17.

Figure 3:
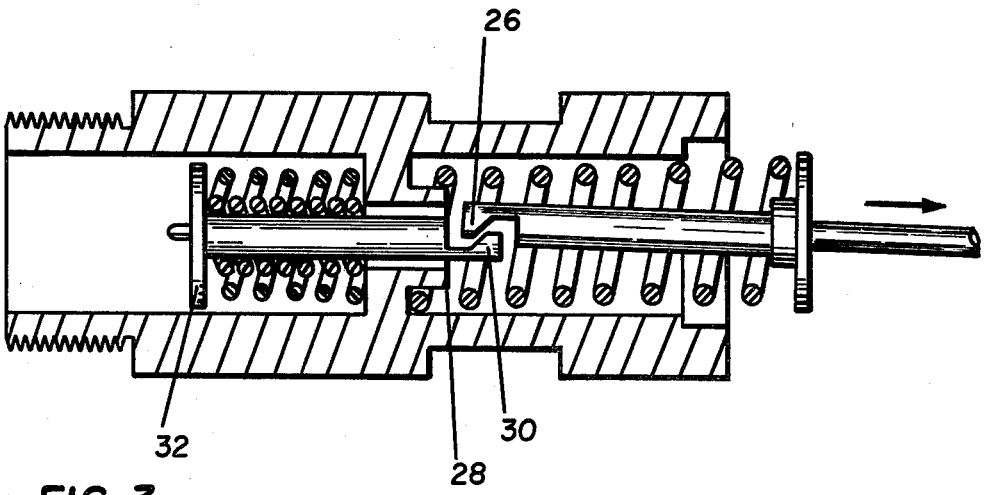
FIG. 3 is a cross-sectional view of the device of FIG. 2, wherein the release cam region of the arming pin has moved out of the constraint of the web.

As illustrated in FIG. 3, as soon as the release cam end 26 of the arming pin 13 is clear of the rearward end 28 of the web 17, the arming pin 13 can move away from the release cam end 30 of the firing pin 12.

Figure 4:
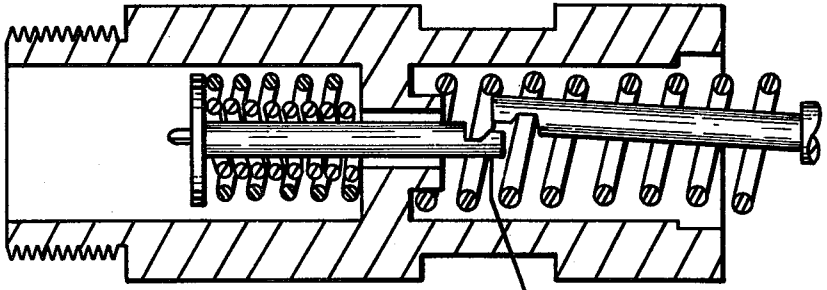
FIG. 4 is a cross-sectional view of the device of FIG. 3, wherein the arming pin and firing pin have just separated.

As soon as the arming pin 13 and the firing pin 12 are separated, as illustrated in FIG. 4, the firing pin is free to be propelled forwardly via the force of the firing springs 15*a* and 15*b* which have been compressed as a result of the rearward force exerted by the lanyard 11 and assist spring 14.

Figure 5:
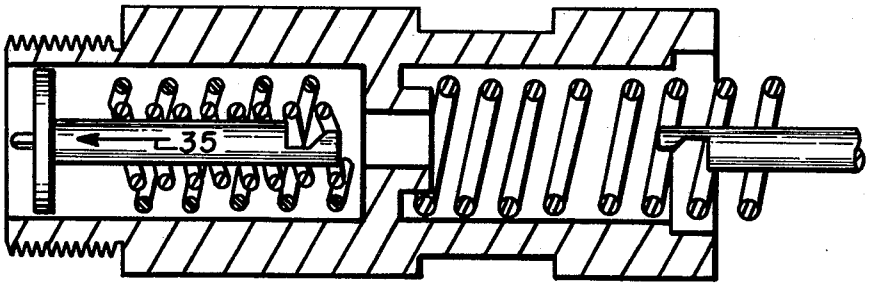
FIG. 5 is a cross-sectional view of the device of FIG. 4, wherein the firing pin has traveled in the forward direction.

FIG. 5 illustrates the firing pin 12 traveling forward in the direction indicated by arrow 35.

Figure 6:
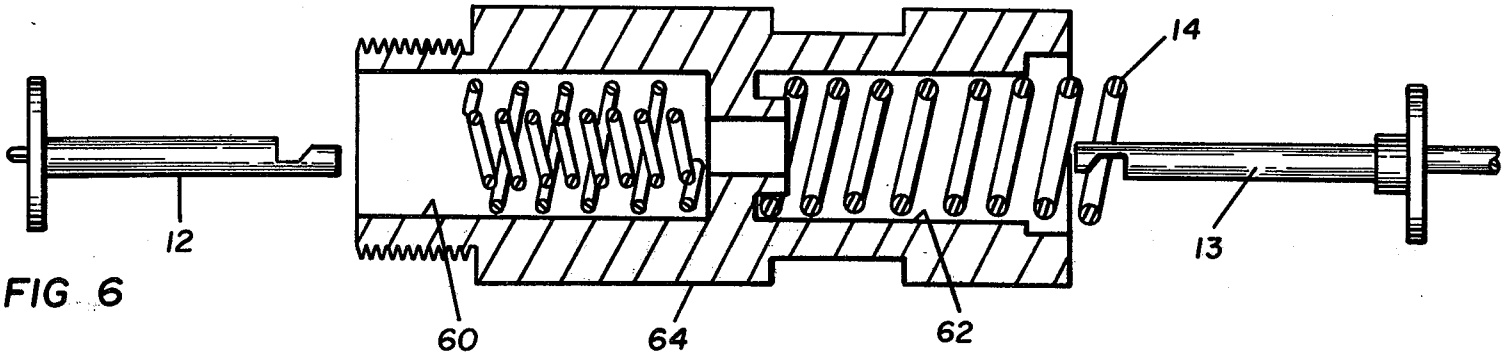
FIG. 6 is a cross-sectional view of the device of FIG. 1, wherein the springs are in place and the firing pin and arming pin are ready for the assembly operation.

The method of assembling the high "G" firing mechanism is not critical and conveniently can follow the reverse of the actuating procedure. As illustrated in FIG. 6, the pair of firing springs 15*a* and 15*b* and the assist spring 14 are inserted into the firing pin chamber 60 and arming pin chamber 62 of the firing mechanism 64. The firing pin 12 and the arming pin 13 are moved toward each other from the position illustrated in FIG. 6 to the position illustrated in FIG. 5. The firing springs 15*a* and 15*b* are compressed until the release cam end 30 of the firing pin 12 extends through the web 17 into the arming pin chamber 62. The assist spring 14 is then compressed between back plate 20 and the spring receiving groove region 19 of the web 17.

Figure 2:
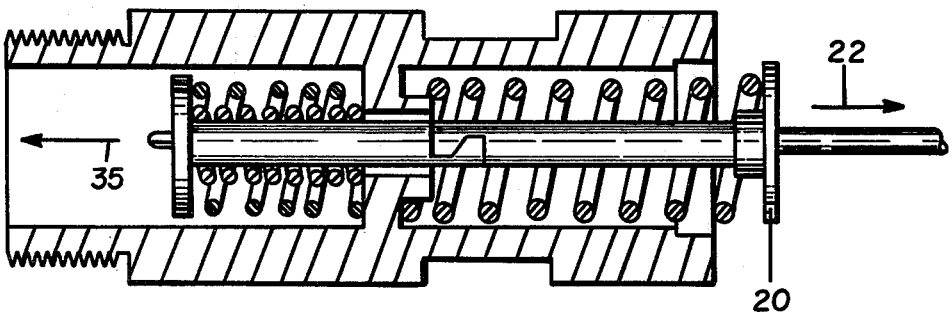
FIG. 2 is a cross-sectional view of the device of FIG. 1, wherein the force on a lanyard has begun to move the firing pin and arming pin in a rearward direction.

The arming pin is moved from the position illustrated in FIG. 4 to the position illustrated in FIG. 3 and then to the interlocked position illustrated in FIG. 2.

The firing springs 15*a* and 15*b* act against the force of the assist spring 14 so that the release cam 16 is positioned within the web 17 and the firing pin 12 and the arming pin 13 are thus maintained in an interlocked condition.

The dimensions of the springs 15*a, b* and 14, the firing pin chamber 60, the arming pin chamber 62 and the distances between the back plate 20 and the firing pin plate 32 are predetermined so that the spring 14 is under compression as previously noted. Thus, while the assist spring 14 is urging the arming pin 13, rearwardly in the direction indicated by the arrow 22, the pair of firing springs 15*a* and 15*b* are urging the firing pin 12 forwardly, in the direction indicated by the arrow 35 with a force equal to the force exerted by the assist spring 14.

The force necessary for the lanyard 11 to move the firing pin 12 to its rearmost position can thus be limited to a specific maximum value, even though after the separation of the firing pin 12 from the arming pin 13 (as illustrated in FIG. 4) the force which drives the firing pin 12 forward is required to be greater than this value. After separation of the firing pin 12 from the arming pin 13, the assist spring 14 ceases to urge the firing pin 12 rearwardly and the only force acting on the firing pin 12 is that exerted by the pair of firing springs 15*a* and 15*b* which is equal to the sum of the compressive force exerted by the lanyard plus that of the preload compression of the firing springs.

By way of further explanation, it should be recognized that in the absence of the precompressed assist spring 14, the force available to drive the firing pin 12 in the forward direction would be directly equal to force available at the lanyard, whether or not the firing springs were precompressed.

What is claimed is:

1. A firing mechanism comprising in combination;

(a) a body member, said body member having a first chamber, a second chamber and a web means separating said first chamber from said second chamber, (b) first spring means, said first spring means being positioned within said first chamber, (c) second spring means, said second spring means being positioned within said second chamber, (d) firing pin means, said firing pin means being positioned substantially in said first chamber and having a spring retaining means at its forward end and a release cam means at its rearward end, (e) arming pin means, said arming pin means being positioned substantially in said second chamber and having a spring retaining means at its rearward end and a release cam means at its forward end, said release cam means of said arming pin means being dimensioned to interlock with said release cam means of said firing pin means, the interlocked cam means of said firing pin means and said arming pin means being positioned within said web means and restrained against release by said web means, and wherein said firing pin means and said arming pin means are movable together in the rearward direction to a position in which said release cam means of said arming pin means and said release cam means of said firing pin means are outside of said web means and free to separate.

2. The firing mechanism of claim 1, wherein said first spring means is compressed between said spring retaining means of said firing pin and said web means.

3. The firing mechanism of claim 2, wherein said first spring means comprises a pair of coaxial coil springs.

4. The firing mechanism of claim 1, wherein said first spring means and said second spring means are precompressed.

5. The firing mechanism of claim 4, further comprising lanyard means affixed to the rearward end of said arming pin.

6. The firing mechanism of claim 4, wherein said first spring means and said second spring means are dimensioned such that they continue to exert opposite forces until said firing pin means is released from said arming pin means.

7. The firing mechanism of claim 6, wherein said arming pin means is released from said firing pin means in response to a rearward force whereby said firing pin is driven in a forward direction with a force equal to said rearward force plus the force due to the precompression of said first spring means.

8. The method of driving a device at a high force in a first direction in response to a lesser force in the opposite direction, comprising the steps of:

precompressing a pair of opposing springs, holding said springs under precompression between a first member and a second member, which are releasably secured to each other, applying a force to said second member in one direction thereby increasing the compression on one of the springs tending to drive said first member in the opposite direction, the force on said second member being assisted by the precompression of the other of said springs, separating said first member from said second member in response to a predetermined force in said one direction and thereby driving said first member in the other direction in response to the force resulting from said precompression of said one of the springs plus the compression resulting from said force in one direction.

* * * * *